US005513461A

United States Patent [19]

Weldle

[11] Patent Number: 5,513,461

[45] Date of Patent: May 7, 1996

[54] LIGHT-WEIGHT AUTOMATIC RIFLE

[75] Inventor: Helmut Weldle, Oberndorf-Beffendorf, Germany

[73] Assignee: Heckler & Koch, Oberndorf, Germany

[21] Appl. No.: 215,854

[22] Filed: Mar. 21, 1994

[30] Foreign Application Priority Data

Mar. 24, 1993 [DE] Germany ..... 93 04 489.5

[51] Int. Cl.[6] ..... F41A 21/48; F41C 23/18; F41G 1/06

[52] U.S. Cl. ..... 42/71.01; 42/75.02; 42/100

[58] Field of Search ..... 42/75.02, 75.03, 42/71.01, 72, 100

[56] References Cited

U.S. PATENT DOCUMENTS

| | | | |
|---|---|---|---|
| 2,970,398 | 2/1961 | Crouch | 42/72 |
| 3,023,527 | 3/1962 | Leek et al. | 42/75.03 |
| 3,488,488 | 1/1970 | Crouch | 42/71.01 |
| 3,512,290 | 5/1970 | Violette, Jr.; et al. | 42/75.01 |
| 3,877,167 | 4/1975 | Keppeler | 42/75.02 |
| 3,939,589 | 2/1976 | Tellie | 42/100 |
| 4,536,982 | 8/1985 | Bredbury et al. | 42/71.01 |
| 4,779,370 | 10/1988 | Cormack | 42/75.02 |
| 5,173,564 | 12/1992 | Hammond | 42/75.03 |
| 5,357,703 | 10/1994 | Chestnut et al. | 42/50 |

FOREIGN PATENT DOCUMENTS

| | | | |
|---|---|---|---|
| 0055307A1 | 7/1982 | European Pat. Off. . | |
| 63100 | 10/1982 | European Pat. Off. | 42/72 |
| 2573524 | 5/1986 | France . | |
| 3620697A1 | 12/1987 | Germany . | |
| 2092277 | 8/1982 | United Kingdom . | |

*Primary Examiner*—Stephen C. Bentley
*Attorney, Agent, or Firm*—Cohen, Pontani, Lieberman, Pavane; Christa Hildebrand

[57] ABSTRACT

The present invention relates to a light-weight automatic rifle with a housing with removable attachments, specifically a longitudinally coaxial barrel, a grip with a trigger mechanism, a shoulder rest, a clip, and sights. The slide slides back and forth in the housing in back of the barrel and along a cheek, resting in its frontmost position against the rear end of the barrel and with locking components that securely engage accommodations in the housing. The housing is a hollow plastic housing and it accommodates a metal sleeve, which is coaxial with the barrel. The rear of the barrel is inserted in the front of the sleeve, and the accommodations are on the rear of the sleeve.

10 Claims, 2 Drawing Sheets

LIGHT-WEIGHT AUTOMATIC RIFLE

BACKGROUND OF THE INVENTION

1. Field of the Invention

The present invention relates to a light-weight automatic rifle with a housing with removable attachments, specifically a longitudinally coaxial barrel, a grip with a trigger mechanism, a shoulder rest, a clip, and sights. The slide slides back and forth in the housing in back of the barrel and along a cheek, resting in its frontmost position against the rear end of the barrel and with locking components that securely engage accommodations in the housing. The housing is a hollow plastic housing and it accommodates a metal sleeve, which is coaxial with the barrel. The rear of the barrel is inserted in the front of the sleeve, and the accommodations are on the rear of the sleeve.

All terms referring herein to spatial direction are to be understood as applied to the weapon conventionally leveled.

2. Description of the Related Art

The housing of a rifle of this type comprises at least two halves stamped out of sheet metal and welded together edge to edge. All parts that accommodate such keying pins as the pins that attach the butt or grip are often reinforced with hollow rivets.

The rear of the barrel is generally engaged by projections from the sheet-metal halves or secured by at least one keying pin in the accordingly assembled housing.

The sights rest at least to some extent on the housing, although some components can also be mounted on the barrel itself.

In contrast to weapons of classic design, which have a slide sliding back and forth in a track that is open at the top, the housing of such a light-weight automatic rifle provides the great advantage of being considerably less susceptible to contamination and weather. The closed and box-like housing can also easily be fabricated of sheet metal, mainly by stamping, and machined only at various points for finishing. The forged parts employed in the classic weapon on the other hand must be extensively and expensively machined.

There are also drawbacks of course to two-part sheet-metal housings. They may have difficult-to-access seams, where the two halves are welded together for instance, that moisture can accumulate in and cannot be kept clean by conventional methods. Rust can deposit in the seams and eventually weaken the material, threatening the safety of the weapon as a whole.

It is impossible to employ stainless-steel sheet instead of the metal employed up to now. Stainless steel is not ductile enough for satisfactorily shaping into a light-weight automatic-title housing.

Welding together the two halves of the housing also results in warping, which necessitates the aforesaid follow-up machining. Finally, the known method of manufacture is expensive.

SUMMARY OF THE INVENTION

With the foregoing state of the art as a point of departure, the object of the present invention is to eliminate the aforesaid drawbacks and in particular to allow cost-effective manufacture with less follow-up machining of a light-weight automatic rifle susceptible to little or no corrosion.

The housing of the rifle in accordance with the present invention is entirely or at least extensively a single hollow plastic component with a metal sleeve embedded in it made, for example, by injection molding. The front of the housing accommodates the barrel and the rear the locked slide. The components that lock the slide engage the sleeve.

Making the stock of such weapons of plastic instead of the traditional wood is admittedly basically known. Still, no more dimensional stability or strength is demanded of the plastic than of the wood.

Making the housing-like grip and slide of a semi-automatic pistol or the housing of an automatic pistol of plastic is also known. No particular precision or strength is expected of the material in these weapons, however, because the ammunition has little muzzle energy.

The accuracy of military pistols and automatic pistols is not especially determinative, and distortions of the type that may occur over time can be accepted as long as they are not detrimental to the weapon's overall function.

A rifle on the other hand shoots a cartridge with a much higher muzzle energy than that shot by a pistol, and in bursts, furthermore, in the event of a light-weight automatic rifle. A higher level of accuracy on the other hand is demanded of the rifle because a single shooter with such a weapon must be able to effectively hit a human target from several hundred meters away.

A metal sleeve that accommodates both the barrel and accommodations for the slide-locking components is inserted in the hollow plastic housing of the light-weight automatic rifle in accordance with the invention. When the weapon is fired, accordingly, the sleeve initially directly transmits the very powerful forces that occur initially from the barrel to the slide without participation by the plastic the housing is made of. Only after complete release of the slide will any forces worth mentioning affect the hollow plastic housing, and they will by that time be considerably weaker than those that occur just after the weapon is fired.

The combined mass of the barrel, sleeve, and slide in existence when the weapon is fired does of course generate a recoil that is transmitted to the housing, but the mass of the housing itself is slight and is easily accommodated by the shooter's shoulder. Plastic can well resist such stresses. Furthermore, the plastic itself can have enough resilience to distribute point stresses over a wider area. Vibration-resistant (hysteretic) plastics can also be of advantage in certain instances.

The sleeve is definitely oblong and surrounded by rough annular grooves accommodating the plastic. Each groove transmits force to the plastic housing from the metal sleeve, and, since there are so many grooves, any point stresses that occur will not permanently deform the plastic.

It is also basically possible for one wall of the grooves to be serrated in order to reduce the space between them. The number of grooves can also be increased to promote transmission of forces and decrease the potential for damage.

It will be preferable for the metal sleeve to have a radial projection in the form of a short pin hammered into a radial bore. The pin helps to stabilize the barrel, which is inserted into the front of the sleeve and secured to it by a screw-on cap. It represents an extremely simple means of ensuring that the barrel will assume a constant and precisely reproducible position.

Radial notches can also be introduced into the outer surface of the metal sleeve and preferably at the rear, leaving radial elevations between them that embed themselves in the plastic of the housing. Such structures will prevent the sleeve from twisting. Eight such notches uniformly and symmetrically distributed around the outer surface of the sleeve has been demonstrated practical.

Inner surfaces of the plastic housing act like a track for the slide to slide along as the weapon reloads. These surfaces can be left smooth enough while the housing is being produced to require no finishing.

It is also possible to employ a plastic for the housing that is hard enough to eliminate significant wear on the housing's cheeks.

Using such a wear-resistant plastic for the housing, however, can be a drawback because such materials are brittle. The housing is accordingly preferably made of high-viscosity plastic and at least, and preferably, one metal cheek is embedded in the housing to prevent the wear expected from the softer plastic. The metal cheek guides the moving slide and protects the plastic from wear. The friction-producing combination of plastic housing and steel slide can be retained otherwise.

A cheek can basically be positioned at any point along the reciprocating interface between the slide and the housing. One cheek will, however, preferably be positioned only where the friction is expected to be severe because for example of components that extend or move across the path of the slide and subject any surface of the housing to excessive stress. Such components are part of the lock, bolts, etc. It must also be taken into consideration that lateral sleeve ejection can subject the slide to a force of reaction, stressing the cheek, usually the left cheek, opposite the ejection port more than the other.

It is for this reason preferable for only the left guide to be a cheek. This cheek will preferably consist of hardened and annealed steel and be surface-treated to decrease friction or to improve the adhesion of the plastic to the cheek or both. The cheek can preferably be nitrocarburated.

The metal cheek is preferably a straight rail perforated by wide bores. The plastic penetrates the bores at least and preferably to some extent when the housing deforms, securing the cheek over a considerable portion of its area. Forces transmitted to the cheek from the slide, which can be considerably powerful when contaminants enter, can accordingly be accommodated by a number of stubby plastic pins constituted by the plastic invading the bores. There is accordingly no risk of the cheek loosening subsequent to considerable use.

The bores are preferably stamped and punched out, with the openings toward the outside, the side of the guide surface, countersunk and those toward the inside, toward the plastic, cuffed. The plastic that invades the bores accordingly hardens into pins. The head of the pins fill up the countersinking. The rail is accordingly reliably locked into position with its inner edge tightly gripping the plastic.

The forces, which occur mainly when the weapon is fired, are transmitted directly to the slide from the barrel by the sleeve, and are consumed in releasing the slide. The total force on the housing is accordingly relatively weak. The housing can therefor be relied on not to deform in any way subsequent to long use.

It is for this reason possible and of advantage for the overall sights to be secured to the hollow plastic housing as in another embodiment of the present invention. It is preferable for the sights as a whole or at least the system regularly employed to be integrated into the housing and accommodated in a channel or depression therein. This approach ideally protects the sights from damage. Certain other features will be present when the plastic is not hard enough to be brittle. Impacts like those that occur when the weapon is dropped are not transmitted to the sights to the extent they are in a conventional light-weight automatic rifle with a steel housing. Such impacts will accordingly also have less effect on adjusting the sights.

It is basically possible for the hollow plastic housing or housing to be manufactured by one of many appropriate procedures, molding for example, and for the metal components to then be inserted in appropriate structures in the plastic.

At least one and preferably all of the metal components, however, are in one practical and preferred embodiment laminated into the hollow plastic housing while it is being molded, preferably by injection.

It is in this event possible to take measures at the mold to ensure highly precise and exact positioning of the metal components. The metal parts are not only snugly surrounded by the plastic but can even be wetted by it. It will accordingly be impossible for any gaps to occur around the metal components to accommodate corrosion.

The metal components are almost all simple machined shapes, turned on automatic lathes for example. They are accordingly not difficult to manufacture out of stainless steel, and the risk of corrosion is entirely ruled out. The metal components can also be surface-treated, hard-chromed for example or bonded for example, before being embedded.

The hollow plastic housing in another embodiment of the invention has a handle integrated into its top and extending along its axis. This handle is hollow and can accommodate a telescopic sight of the type in itself known in conjunction with light-weight automatic rifles.

Screws and similar structures for adjusting such sights can be accommodated to advantage in the housing. It is preferable for the walls of the housing to be generally thicker than those of a sheet-metal housing so that, when headless screws are employed to adjust the sights, they will not project out and be unintentionally turned. The screws can then be secured by sealing the residual bores with lacquer.

These components of the sights in another embodiment of the invention are preferably threaded bushings, two of which (the one for elevation and the one for sweep) are in the wall of the handle.

Another embodiment of the invention also has, in addition to the regular sights, a lens-less emergency back-up sight on the top of the handle.

Other devices that have previously been manufactured separately and riveted or welded to the sheet-metal housing can in accordance with another embodiment of the invention also be molded onto the hollow plastic housing while it is being manufactured. A shackle that accommodates a carrying sling, preferably a depression with a vertical rod extending across it, can be integrated into the rear of the hollow plastic housing, preferably into one side, and more preferably into the left side in another preferred embodiment of the invention.

Half a hinge can be integrated into one side of the rear of the hollow plastic housing opposite the shackle in another embodiment of the invention, preferably in the form of a number of overlapping projections with an aligned bore extending through it. The bore is molded into the housing and accommodates a pin that extends through a matching hinge half on the shoulder rest.

Opposite the resulting hinge and accordingly immediately below the shackle on the inner surface of the hollow plastic housing is a barrier recess, which can be engaged by a bar articulated to the shoulder rest.

The shoulder rest is secured ready-to-use as long as the bar is in the barrier recess, and can be folded laterally in front of the fight side of the housing once the bar has been released.

The shoulder rest is a frame with at least one opening through it. Once it has been folded forward, the opening or openings will be in front of the ejection port and the shells can be ejected unimpeded. The weapon will accordingly be ready to use even with the shoulder rest forward.

In spite of the high demands on the various embodiments of the hollow plastic housing with respect to precision, it will be ready for installation immediately once the housing has been removed from the injector and optionally once the sprue has been removed—broken or sliced off, that is—without any machining. The surface treatment absolutely necessary in a metal housing can also be eliminated.

The plastic can also be colored any desired color, black, khaki, or olive-green, or white for winter for instance.

The outer surface of the hollow plastic housing in another embodiment can be rendered matt or rough by appropriately modifying the mold. The rifle's housing will accordingly not reflect like a conventional housing of burnished or deep-drawn.

The hollow plastic housing in accordance with the present invention is accordingly not only more corrosion-resistant but also primarily quicker and easier to manufacture than a comparable sheet-metal housing.

DESCRIPTION OF THE PREFERRED EMBODIMENTS

Figure 1:
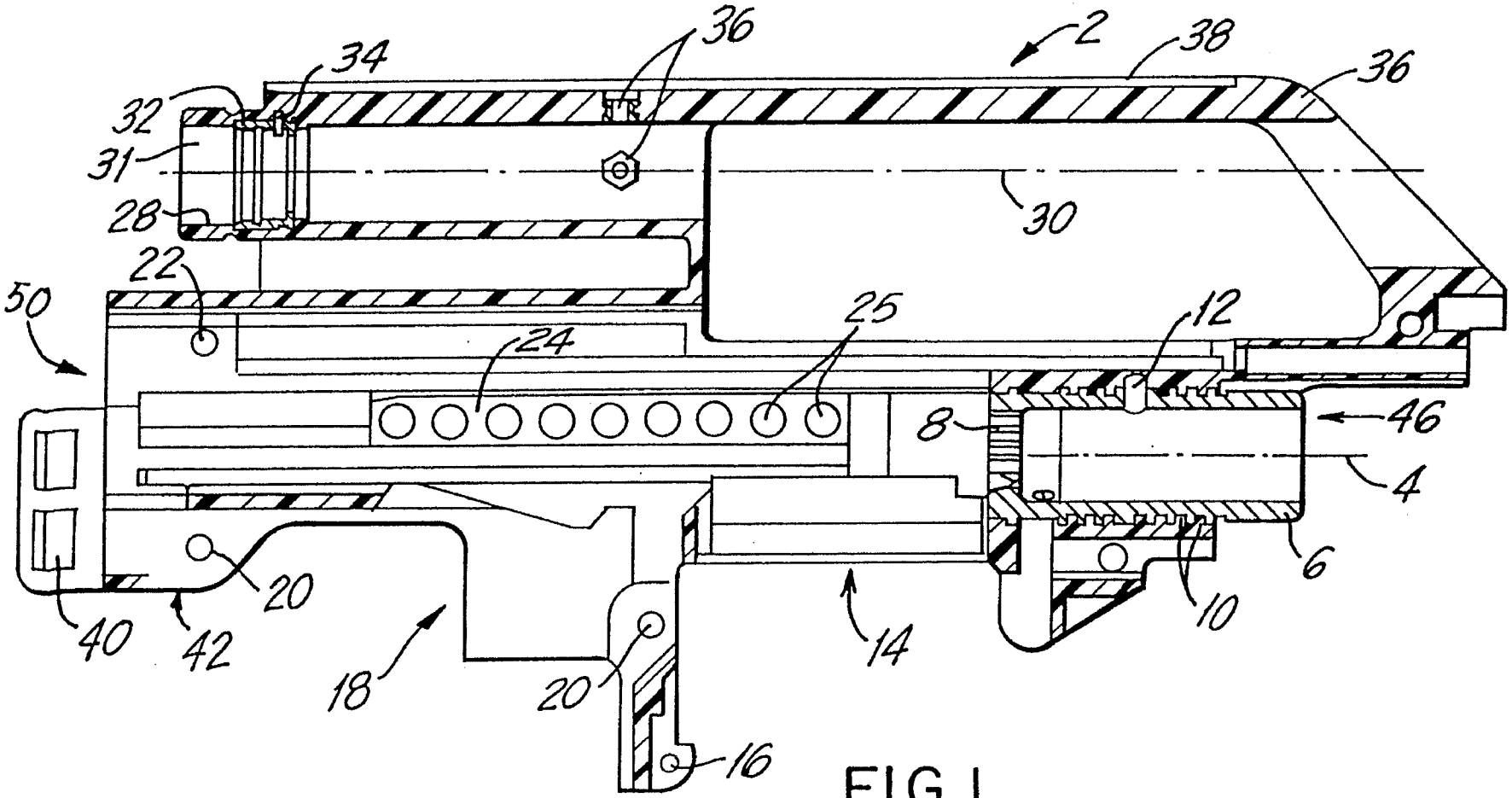
FIG. 1 shows an axial section of the housing of the light weight automatic rifle.

One embodiment of the present invention will now be described by way of example with reference to FIG. 1 and FIG. 2.

The hollow plastic housing 2 accommodates coaxial with its longitudinal axis 4 an essentially cylindrical steel sleeve 6. A cylindrical bore extends essentially all through, and narrows at the rear end (at the left of the drawing) of, sleeve 6. Distributed around that end of the sleeve are radially projecting bars 8. Keys on the head of an unillustrated slide can be inserted forward (toward the right) between these structures. The head is now rotated, and the keys will engage behind bars 8. The slide is accordingly locked. The unillustrated barrel is secured inside sleeve 6, which attaches it to the slide.

Distributed around the outside of sleeve 6 is a series of grooves 10. Grooves 10 are interrupted by unillustrated serrated notches and invaded by the plastic that housing 2 is made of. The grooves transmit force longitudinally and the notches transmit it around sleeve 6 and accordingly around the barrel.

Inside hollow plastic housing 2 and below and behind sleeve 6 is a magazine receiving port 14. Magazine receiving port 14 accommodates a magazine clip 48 inserted from below.

A bore 16 molded into hollow plastic housing 2 accommodates a clip holder.

Behind magazine receiving port 14 is another opening 18 that opens downward and allows the unillustrated slide to operate in conjunction with components of the unillustrated firing mechanism.

Figure 2:
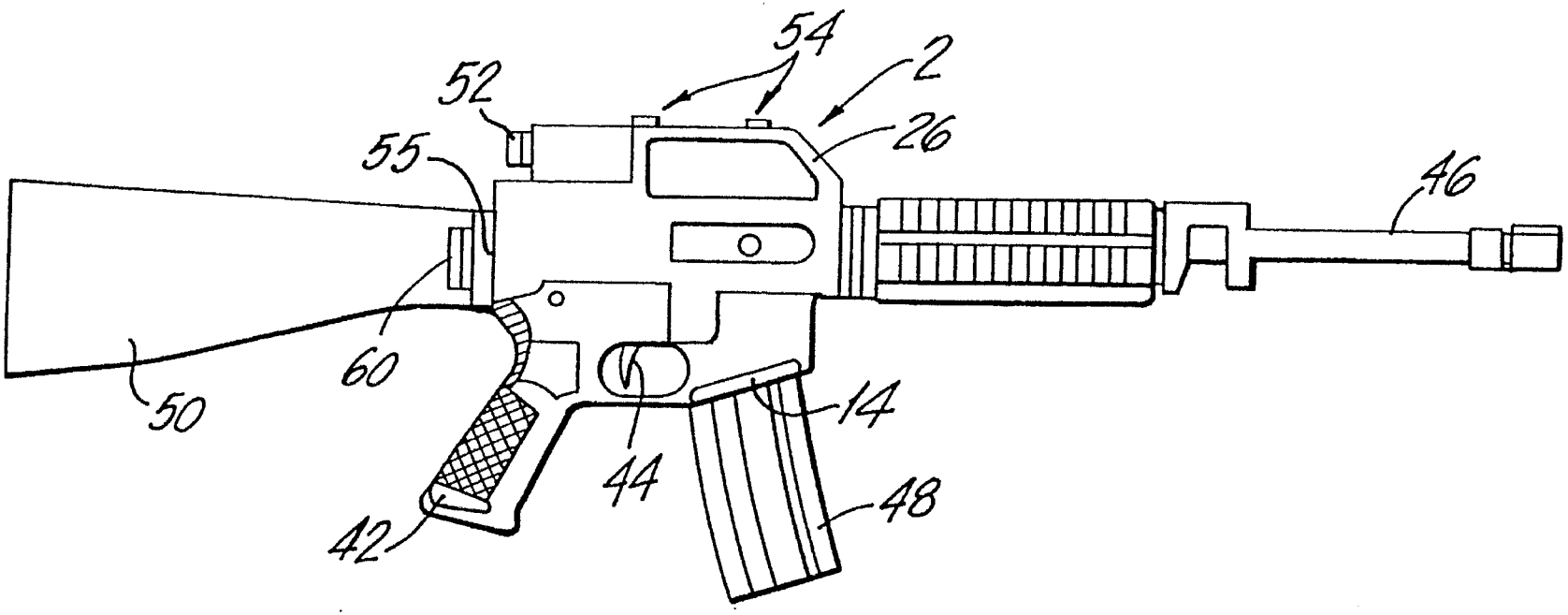
FIG. 2 shows a side elevation of the assembled plastic rifle with attachments.

Molded into hollow plastic housing 2 on each side of opening 18 is a bore 20 that accommodates grip 42 shown in FIG. 2. Above each bore 20 is another bore 22. Bore 22 secures an shoulder rest 50 shown in FIG. 2 that accommodates securing and shock-absorbing springs.

Hollow plastic housing 2 incorporates a passage extending back parallel with longitudinal axis 4 from the rear of the housing and open at the rear. The slide slides back and forth inside this passage. Molded into housing 2 along the left inner surface of the passage and paralleling longitudinal axis 4 is a cheek 24. As will be evident from the drawing, cheek 24 is perforated by bores 25. These bores are invaded by the still soft plastic when the housing is molded. The unillustrated slide slides along the exposed surface of the cheek.

Superimposed elongated webs project into the passage from its right-side inner surface, the surface opposite cheek 24. The exposed inner edges of these webs extend describe a vertical plane and constitute a surface opposite cheek 24 and helping to guide the slide. Between the two lowermost webs is a cartridge-ejection port. Behind the rear edge of the port is an outward projection. The projection prevents the entire port from coming into contact with the ground or floor when the rifle is laid down on its right side. The project also constitutes a baffle that diverts ejected casings away from the shooter. Below the metal sleeve is a magazine clip receiving port 14 for receiving the magazine clip 48.

The passage that accommodates the slide is open at the front, and the slide can at that point engage the top of a plastic section that surrounds sleeve 6 from above. An unillustrated loading lever for actuating the slide will preferably be mounted on the same area of the slide. Further, FIG. 2 illustrates how the above-described hollow plastic housing rifle is assembled with attachments, the barrel 46 screwed into the steel sleeve 6 of FIG. 1, the shoulder rest 50 mounted to hinge 40 of FIG. 1, the sight 52, emergency back-up sights 54 disposed on carrying handle 26, a trigger mechanism 44, a grip 42, a carrying sling shackle 60. The shoulder rest may also be pivotally hinged to the plastic housing by a hinge 55.

A carrying handle 26 is integrated into the top of hollow plastic housing 2. Handle 26 has a projection to the rear in the form of a tube. The inner surface 28 centers on an axis 30 paralleling longitudinal axis 4.

The forward web, which extends as far a handle 26, of hollow plastic housing 2, is breached around axis 30, creating an open channel 31 that extends all the way through the handle from front to rear.

A metal mount 32 is embedded in inner surface 28 just forward of the rear end of the channel. Mount 32 accommodates the rear lens of a sight, secured by a pin 34.

Just behind the opening in the handle that surrounds the tensioner, the inner surface 28 is penetrated by two threaded bushings 36 molded securely into the plastic of housing 2. Bushings 36 preferably accommodate an inside thread that accept screws. The screws are employed to adjust the vertical and horizontal position of the unillustrated sight components.

An emergency back-up sight 54 of FIG. 2 is mounted on the top of handle 26.

The front end of sleeve 6 features another regular or fine thread and extends forward out of hollow plastic housing 2. The barrel 46 has a flange around its rear end. When that end is introduced into sleeve 6, the flange rests against the sleeve's front end. A threaded cap is slipped over the barrel in front of the flange and screwed onto the threads in the outer surface of the sleeve, forcing the flange against the sleeve.

It accordingly becomes possible to adapt a standard rifle to the specifications of individual customers by screwing in different barrels, accompanied if necessary by appropriate securing springs and shipped along with appropriate clips.

A defective barrel, one that bells out at the muzzle for example, can be replaced at the battle front with a simple tool, a wrench for instance. A barrel can also be replaced when necessary by a special silenced barrel or by a barrel with other accessories, wire cutters for example.

What is claimed:

1. A light-weight automatic rifle comprising a plastic housing including a handle portion, a cylindrical metal sleeve having an axis, at least one metal cheek, the plastic housing surrounding said handle portion, said metal cheek and said plurality of connecting aperture means, and wherein said metal sleeve includes radially projecting grooves on the outside for engaging with said plastic housing and said metal sleeve is disposed-within a distance from said metal cheek.

2. The light-weight automatic rifle of claim 1, wherein said plastic housing is made by injection molding.

3. The light-weight automatic rifle of claim 1, further comprising a plurality of connecting aperture means for engaging to at least one attachment.

4. The light-weight automatic rifle of claim 3, wherein said at least one attachment is a sight.

5. The light-weight automatic rifle of claim 3, wherein said at least one attachment is an emergency back-up sight.

6. The light-weight automatic rifle of claim 3, wherein said at least one attachment is a barrel disposed in said metal sleeve so as to be mounted on said axis of said sleeve.

7. The light-weight automatic rifle of claim 6, further comprising a carrying sling shackle.

8. The light-weight automatic rifle of claim 3, wherein said at least one attachment includes a grip and a trigger.

9. The light-weight automatic rifle of claim 3, wherein said at least one attachment is a shoulder rest pivotally attached to said plastic housing.

10. The light-weight automatic rifle of claim 1, further comprising a magazine receiving port located in the plastic housing and adjacent to the metal sleeve.

* * * * *